US006044865A

United States Patent [19]

Kreitmayr et al.

[11] Patent Number: 6,044,865

[45] Date of Patent: Apr. 4, 2000

[54] SANITARY FITTING IN THE FORM OF A SINGLE-LEVER MIXER TAP

[75] Inventors: Lorenz Kreitmayr, Eschelbach; Martin Eicheldinger, Rohrbach, both of Germany

[73] Assignee: Santech GmbH, Germany

[21] Appl. No.: 09/202,162

[22] PCT Filed: Jun. 9, 1997

[86] PCT No.: PCT/DE97/01164

§ 371 Date: Dec. 9, 1998

§ 102(e) Date: Dec. 9, 1998

[87] PCT Pub. No.: WO97/47828

PCT Pub. Date: Dec. 18, 1997

[30] Foreign Application Priority Data

Jun. 10, 1996 [DE] Germany ..... 196 23 104

[51] Int. Cl.[7] ..... F16K 31/08; E03C 1/05

[52] U.S. Cl. ..... 137/607; 251/65; 251/129.03; 251/129.04

[58] Field of Search ..... 137/607; 251/129.03, 251/129.04, 65

[56] References Cited

U.S. PATENT DOCUMENTS 3,212,751 10/1965 Hassa ..... 251/129.03 X
4,583,709 4/1986 Ward ..... 251/129.03 X
5,358,213 10/1994 Pilolla ..... 251/129.03
5,529,281 6/1996 Brudnicki ..... 251/129.03

FOREIGN PATENT DOCUMENTS 245577 11/1987 European Pat. Off. .
2206397 1/1989 United Kingdom .

*Primary Examiner*—Stephen M. Hepperle
*Attorney, Agent, or Firm*—Domingue & Waddell, PLC

[57] ABSTRACT

A sanitary fitting is provided having a housing part (5) and an exit part (6) containing the exit channel (7), wherein in the housing part (5) a mixer tap (11) for mixing cold and warm fluid and for controlling the flow rate is positioned and is actuatable between a closed final position and an opened final position by a control rod (10) connected to an actuating lever (8), wherein an electrically controllable valve (14) is fitted downstream of the mixer tap (11) by the means of which a fluid emanating from the mixer tap (11) before entering into the exit channel is guided, wherein the electrically control valve (14) by the means of a control electronic circuit (39) is connected to a proximity sensor (37) and, wherein the electrically controllable valve (14) additionally can be controlled mechanically by means of the actuating lever (8) via the control rod (10), wherein a lever arrangement (12) is provided between the control rod (10) and the electrically controllable valve (14) which mechanically is adjusting the electrically controllable valve (14).

9 Claims, 3 Drawing Sheets

SANITARY FITTING IN THE FORM OF A SINGLE-LEVER MIXER TAP

Figure 1:
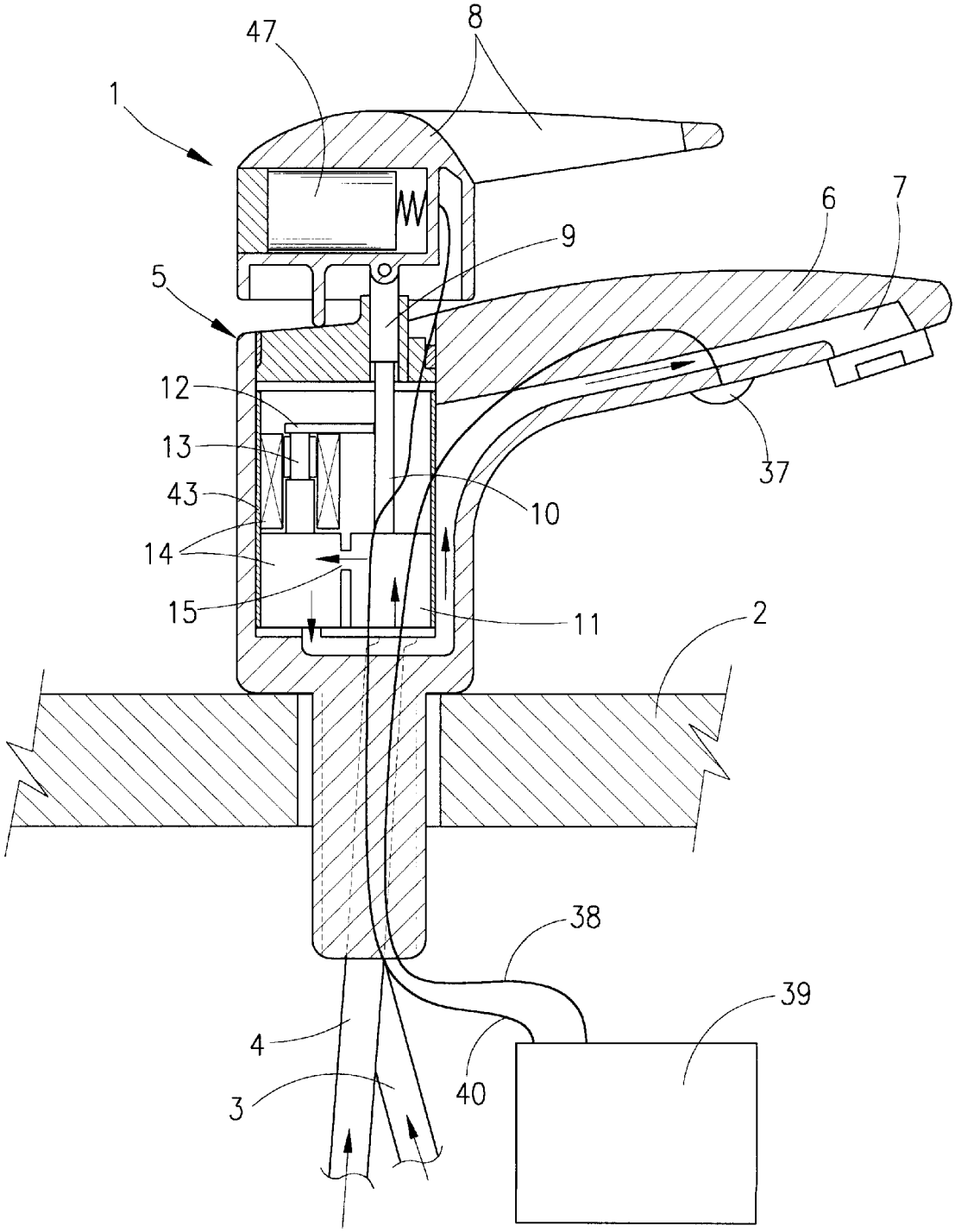

The invention concerns a sanitary fitting in the form of a single-lever mixer in accordance with the features of the classifying portion of claim 1.

Sanitary fittings in the form of single-lever mixers are known. They have substantially replaced the previously usual mixer taps or faucets having two manually adjustable valves for cold and hot water, and usually comprise a mixer tap or faucet with only one actuating lever which, by way of a control bar, actuates a control plunger arranged in the mixer tap. The actuating lever is both laterally and also vertically pivotable. While the mixing of cold and hot water is effected by the lateral pivotal movement, regulation of the amount of water is implemented by the vertical pivotal movement.

In the known single-lever mixers, both turning the fitting on and off and also temperature selection and quantitative regulation of the water are effected manually. That has been found to be disadvantageous because an optimum water temperature, once adjusted, or a volume flow which has once been adjusted as being the optimum flow, has to be repeatedly re-set after each time that the fitting is turned off, and that is a troublesome and laborious procedure. A considerable amount of water which is not put to a useful purpose is required for such adjustment operations.

In particular for reasons of hygiene (very dirty hands, the risk of transmitting pathogens in public toilets etc.), it is also desirable to be able to actuate the single-lever mixer without touching it.

DE 25 33 527 A1 discloses a sanitary fitting having two manually adjustable valves for cold and hot water, wherein a solenoid valve is incorporated into the outlet duct. The solenoid valve is actuated by way of a proximity switch by means of an electronic control system as soon as an article passes into the monitoring range of the proximity switch. Apart from the not very attractive configuration of a sanitary fitting of that kind which is controlled in a touch-free manner, in which parts of the solenoid valve and electric lines are fitted on the outlet portion in such a way that they are clearly visible, that fitting suffers from the disadvantage that it is no longer possible for the fitting to be turned on and off manually, as in the case of conventional, manually actuable fittings. If therefore the power supply for the solenoid valve fails for any reason, it is no longer possible to draw water from the fitting.

The object of the present invention is to provide a sanitary fitting which is in the form of a single-lever mixer and which can be turned on and off both in a touch-free manner and also manually.

According to the invention that object is attained by the features of the characterising portion of claim 1. Further, particularly advantageous embodiments of the invention are disclosed in the appendant claims.

The invention is essentially based on the notion of connecting on the downstream side of the mixing unit of the single-lever mixer an electrically controllable valve, the function of which depends not only on the switching signals of the electronic control system but also the position of the actuating lever of the fitting. For that purpose preferably the control bar which is connected to the actuating lever and the electrically controllable valve are mechanically coupled together in such a way that on the one hand the valve remains closed in spite of corresponding opening signals etc. produced by the proximity sensor, if the mixing unit is also closed (the actuating lever of the fitting is generally in its lower position). On the other hand the electrically controllable valve also remains opened without corresponding opening signals from the proximity sensor if the mixing unit is totally opened by actuation of the control bar (the lever of the fitting is generally in its upper position).

In a predeterminable region between the closed and the completely opened positions of the mixing unit, opening and closing of the electrically controllable valve is effected solely by the control signals which are generated by the proximity sensor and processed by the electronic control system.

If therefore the power supply to the electronic control system in the single-lever mixer according to the invention fails, water can nonetheless be drawn off with the fitting by virtue of the lever being pivoted from the closed position of the mixing unit into the completely opened position. So that in that position the water does not abruptly spray and jet into the corresponding basin, it has been found advantageous for the control plunger and the cartridge case of the mixing unit, which surrounds the control plunger, to be of such a configuration that there is a reduction in the flow of liquid, in the completely opened position of the mixing unit.

In a particularly simple and advantageous manner, mechanical actuation of the valve can be effected in dependence on the position of the control bar if the electrically controllable valve is a per se known solenoid valve. Solenoid valves of that kind comprise a magnetic switching portion and a mechanical valve portion. In that case the magnetic switching portion has a control pin which is provided for opening and closing the valve and which is arranged to be axially displaceable by a solenoid against the pressure of a spring. There is also provided a permanent magnet which, after the solenoid is switched off, holds the control pin in its position of being displaced against the pressure of the spring.

In order to provide that the solenoid valve remains closed in the closed position of the mixing unit in spite of the corresponding magnetic coils being powered or remains opened without the corresponding magnetic coils being powered if the mixing unit is completely opened, in accordance with the invention the control bar is mechanically connected by way of at least one lever to the permanent magnet of the magnetic switching portion. If the axial length of the control bar is altered, the permanent magnet is therefore also displaced and varies its spacing in relation to the control pin of the switching portion, more specifically in such a way that in the closed position of the mixing unit the permanent magnet no longer exerts an effect that is relevant in terms of function on the control pin and the permanent magnet continuously attracts the control pin in the completely opened position of the control bar.

In an advantageous embodiment of the invention the lever is in the form of a deflection or shift lever so that pulling the control bar causes a movement of the permanent magnet towards the control pin, while the opposite movement of the control bar and the permanent magnet is detected by a sliding member or cam which is arranged on the control bar and along which the one end of the shift lever slides.

So that the solenoid valve only has to exert a low level of force upon controlling the through-flow, it has proven to be advantageous to use a pre-controlled or pilot-controlled valve in which there is provided a diaphragm or a piston which moves relative to the valve seat under the effect of the water pressures obtaining at both sides thereof, and has a pilot opening. To operate the valve, the pilot opening is closed or opened by the control pin which can be actuated by the solenoid of the switching portion.

A substantial advantage of the single-lever mixer according to the invention is that the mixing function of the fitting is not adversely affected, irrespective of whether the fitting is operated in a touch-free mode or whether it is operated purely manually for example in the event of a power failure.

A further substantial advantage is that it is possible to omit the expensive sealing arrangement using relatively expensive ceramic sealing discs, that is required in the case of conventional single-lever mixers. For, low demands can be made in respect of the sealing function of the mixing unit in its closed position because the downstream-disposed solenoid valve is responsible for affording satisfactory sealing integrity.

It has also proven to be particularly advantageous that a person who is not familiar with the single-lever mixer according to the invention can draw water even if, in the case of touch-free operation of the fitting, that person does not activate the electrically controllable valve by means of the proximity sensor. For, such a person will operate the single-lever mixer in conventional manner by pivoting the actuating lever and also obtains water in the end position of the lever because the valve is opened by the mechanical displacement of the permanent magnet.

For aesthetic reasons but also for safety reasons it has also proven to be advantageous if the electrically controllable valve including the electric control lines are arranged within the housing of the single-lever mixer. Those parts are therefore not visible from the exterior.

Figure 2:
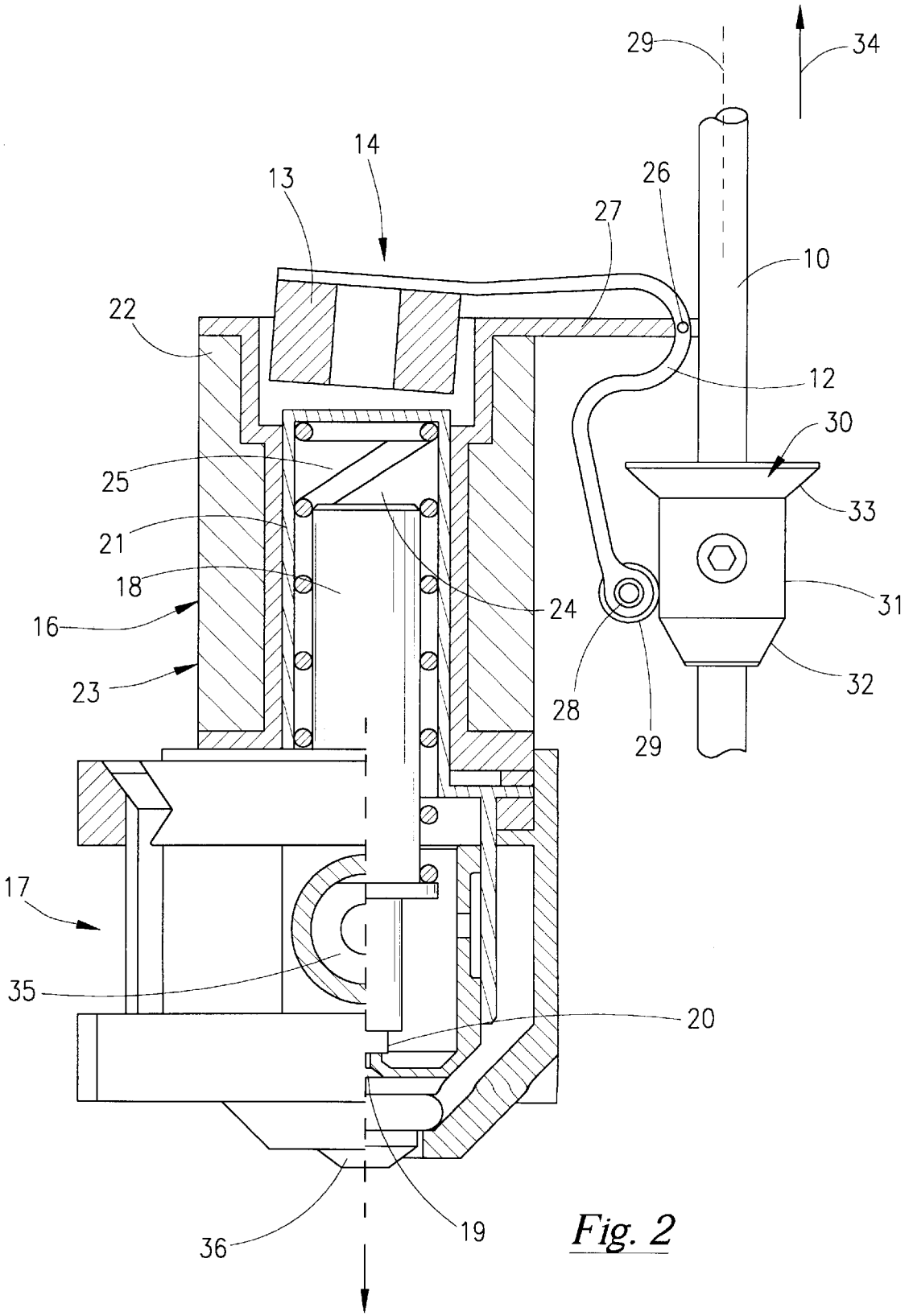
Figure 3:
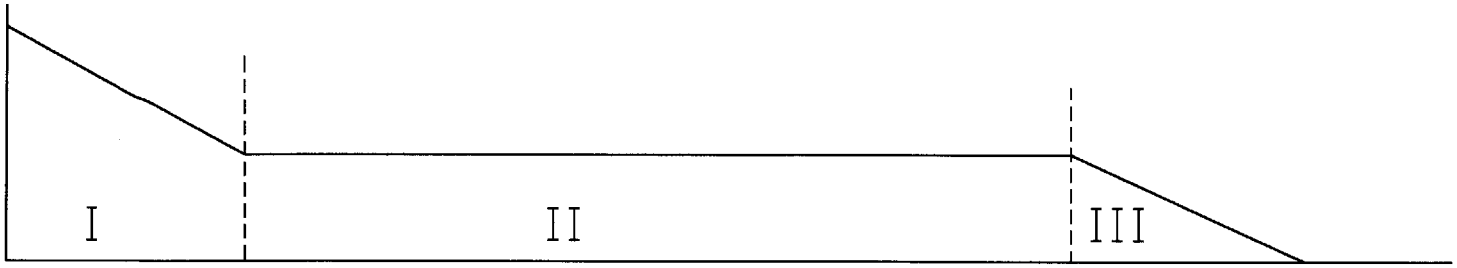
Figure 5:
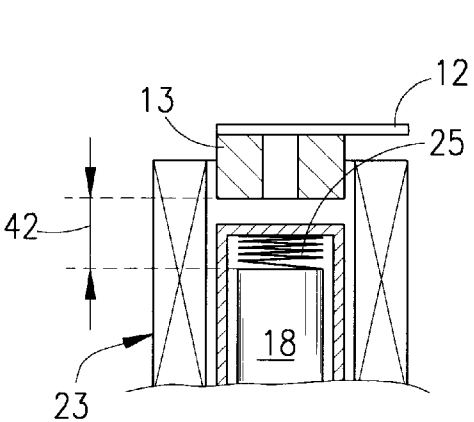
Figure 6:
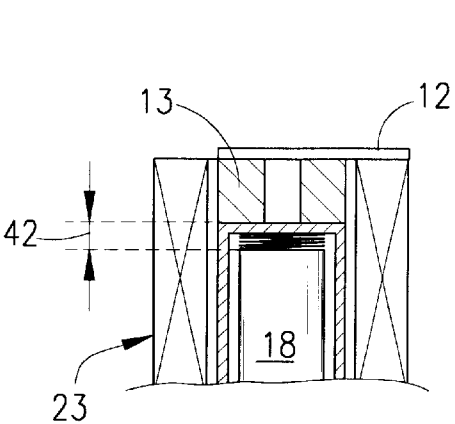
Figure 4:
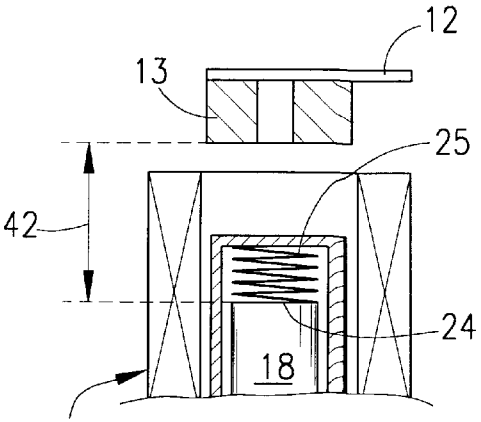

Further details and advantages of the invention will be apparent from the following embodiments given by way of example and described with reference to Figures in which:

FIG. 1 is a view in longitudinal section through a single-lever mixer according to the invention with diagrammatically indicated mixing unit and a solenoid valve which are both actuable by the same control bar, FIG. 2 is a partial section through a first embodiment of a solenoid valve with pivotable permanent magnet which is connected to the control bar by way of a deflection lever, FIG. 3 shows a diagram which reproduces the position of the permanent magnet of the solenoid valve in dependence on the position of the control bar, and FIGS. 4–6 diagrammatically show the positions of the permanent magnet in relation to the control pin of the solenoid valve, such positions corresponding to the individual regions identified by I–III in FIG. 3.

Referring to FIG. 1, reference numeral 1 therein denotes a single-lever mixer which is secured for example to a wash basin 2. The single-lever mixer 1 is connected both to a cold water pipe 3 and a hot water pipe 4.

The single-lever mixer comprises a housing portion 5 with a rigid outlet 6 with an outlet duct 7 and an actuating lever 8 in the form of a head portion. The actuating lever 8 is connected by way of an intermediate portion 9 and a control bar or rod 10 to a mixing unit 11. In addition the control bar or rod 10 is mechanically connected by way of a deflection or shift lever 12 to the permanent magnet 13 of a solenoid valve 14.

From the cold and hot water pipes 3, 4 the water passes by way of corresponding inlets into the mixing unit 11, it is there mixed in accordance with the position of a control plunger (not shown) connected to the control bar 10 and it then passes from the outlet 15 of the mixing unit 11 by way of the solenoid valve 14 to the outlet duct 7.

The solenoid valve 14 (see FIG. 2) is a per se known pre-control or pilot valve which is used as a switching valve. It comprises a magnet switching portion 16 and a mechanical valve portion 17.

The switching portion 16 includes a control pin 18 whose lower end extends into the valve portion 17 and there closes a pilot opening 19 of a piston 20. The upper region of the control pin 18 is surrounded by a sleeve 21 of non-magnetic material, which in turn is arranged within the cylindrical coil 22 of a solenoid 23. The upper end of the control pin 18 bears by means of a compression spring 25 against the sleeve 21.

The permanent magnet 13 which in accordance with the invention is fixed to the shift lever 12 is arranged pivotably about an axis 26 on a cantilever portion 27 of the solenoid valve 14. On its side 28 remote from the permanent magnet 13 the shift lever 12 is provided with a roller 29 which bears against a rotationally symmetrical sliding member or cam 30 which is secured to the control bar 10. The member or cam 30 has essentially three different regions 31–33.

If the control bar 10 is drawn in the direction of the arrow 34, the position of the shift lever 12 and therewith also that of the permanent magnet 13 do not change as long as the roller 29 is supported against the member or cam 30 in the region 31 thereof. In the regions 32 and 33 respectively in contrast the permanent magnet 13 is pivoted in a direction towards control pin 18 and away from the control pin 18 respectively. As will be described in greater detail hereinafter with reference to FIGS. 3–6, the solenoid valve 14 loses its bistable characteristics in those positions.

The fluid inlet and outlet of the solenoid valve 14 are identified by reference numerals 35 and 36.

Provided on the underside of the outlet 6 of the single-lever mixer 1 is a proximity sensor 37 (FIG. 1) which is connected by way of an electric line 38 to an electronic control system 39. The electronic control system 39 is in turn connected by way of further electric lines 40 both to a power supply source 41 which is disposed in the form of a battery in the head portion 8 and also to the solenoid valve 14.

The mode of operation of the single-lever mixer 1 according to the invention will be described in greater detail hereinafter with reference to FIGS. 3–6. In this respect, for the sake of simpler representation in FIGS. 4–6 the pivotal movement of the permanent magnet 13 has been replaced by a displacement of the magnet in the vertical direction.

The single-lever mixer 1 is firstly assumed to be in its closed position. This means that the actuating lever 8 (FIG. 1) is pressed downwardly and the mixing unit 11 is also closed.

In addition, in this position the spacing 42 of the permanent magnet 13 from the end 24 of the control pin 18 of the solenoid valve 14 (FIG. 4) is selected to be so great that, after the solenoid 23 is switched off, the control pin 18 cannot be held by the permanent magnet 13 and is moved into its lower switching position by the spring 25. In this case therefore the solenoid valve has only one stable position in which the control pin closes the pilot opening 19 of the piston 20. Electrical opening of the solenoid valve 14, for example due to interference or disturbance factors (for instance during a vacational absence), is not possible.

Upon a gradual upward pivotal movement of the actuating lever 8 the solenoid valve 14 also still remains closed within the pivotal region identified by I in FIG. 1, which corresponds to the sliding member or cam region identified by reference 33 in FIG. 2.

If the spacing 42 between the permanent magnet 13 and the control pin 18 further decreases by virtue of the actuating lever 8 being pulled, the pivotal region of the actuating lever, which is identified by II in FIG. 3 and which corresponds to the region 31 of the member or cam 30 is reached. Within that region, after the solenoid 23 is switched off, the control pin 18 is held solely by the magnetic force of the permanent magnet 13 against the return force of the spring. The control pin 18 is in its upper switching position and the valve is opened.

The control pin 18 is actuated back into its lower switching position by renewed activation of the solenoid 23 which opposes the permanent magnet 13 after the current direction is switched over. The closed position of the solenoid valve 14, which is attained as a result, is also stable as the force of the spring 25 is greater than the attraction force, which remains at that spacing, of the permanent magnet 13. The solenoid valve 14 therefore operates in a bistable fashion in the pivotal region II.

In the pivotal region which is identified by III in FIG. 3 and which corresponds in FIG. 2 to the region 32 of the member or cam 30 the spacing 42 of the permanent magnet 13 is so small that the control pin 18 constantly remains in that position due to the magnetic force of the permanent magnet 13, against the force of the spring 25. Electrical closure of the solenoid valve is not possible. The valve has only one stable position.

It will be appreciated that the invention is not limited to the above-described embodiment. Thus, depending on the manner of fixing the actuating lever on the control bar for implementing corresponding functions, it is possible to provide for a reversal of the direction of movement of the control bar so that, to actuate the electrically controlled valve 14, the connecting lever 12 has to be adapted to correspond to such movements.

In addition, the power supply for the valve, the proximity sensor and the electronic system does not necessarily need to be a battery disposed in the head portion 8. On the contrary it is also possible to use a mains unit which is integrated for example in the electronic control system.

It has also proven to be particularly advantageous if the mixing unit 11 and the electrically controllable valve 14 are arranged in a replaceable cartridge. That arrangement on the one hand permits simple and inexpensive assembly of the fitting. In addition the fitting can be quickly repaired by replacing the cartridge in the event of faults in the mixing unit or the valve. A suitable diagrammatically illustrated cartridge is denoted by reference numeral 43 in FIG. 1.

Finally the housing portion with mixing unit and valve and the outlet of the sanitary fitting do not necessarily need to be combined together in one unit. Particularly in the case of bath fittings it has proven to be advantageous for the two portions of the fitting to be arranged on the corresponding wall of the bathroom which adjoins the bath tub.

What is claimed is:

1. A sanitary fitting performed as a single-lever mixer having a housing part (5) and an exit part (6) containing the exit channel (7), wherein in the housing part (5) a mixer tap (11) for mixing cold and warm fluid and for controlling the flow rate is positioned and is actuatable between a closed final position and an opened final position by a control rod (10) connected to an actuating lever (8), wherein an electrically controllable valve (14) is fitted downstream of the mixer tap (11) by the means of which a fluid emanating from the mixer tap (11) before entering into the exit channel is guided, wherein the electrically controllable valve (14) by the means of a control electronic circuit (39) is connected to a proximity sensor (37) and, wherein the electrically controllable valve (14) additionally can be controlled mechanically by means of the actuating lever (8) via the control rod (10), wherein a lever arrangement (12) is provided between the control rod (10) and the electrically controllable valve (14) which mechanically is adjusting the electrically controllable valve (14) in such a way a) that in the closed end position of the mixer tap (11) or within a first pivot range (I) of the actuating lever (8) following said end position respectively, in spite of electric control signals applied to the electrically controllable valve (14) the valve (14) is remaining closed, b) that in the completely opened final position of the mixer tap (11) or within a third pivot range (III) preceding said end position the valve (14) is remaining opened, too, in spite of electric control signals applied to the valve (14) and, c) that within a second pivot range (II) of the actuating lever (8) being positioned between the first and the third range the electrically controllable valve (14) is remaining closed and is opened only by the means of activation by the proximity sensor (37).

2. A single-lever mixer according to claim 1, wherein the electrically controllable valve (14) is a solenoid valve having a magnetic switch member (16) and a mechanic valve member (17), wherein the magnetic switch member (16) is having a control pin (18) acting on the valve member (17), said control pin (18) being axially displaceable by an electromagnet (23) against the pressure of a spring (25), wherein above the side of the control pin (18) being distant from the valve member (17) a permanent magnet (13) is provided which by means of the lever arrangement (12) is connected to the control rod (10) in such a way that the distance (42) of the permanent magnet (13) with respect to the control pin (18) can be changed corresponding to the axial position of the control rod (10) in such a way that in the closed position of the mixer tap (11) or in the first pivot range (1) of the actuating lever (8) respectively, the permanent magnet (13) has no more any effect on the control pin (18) being relevant to function, wherein in the completely opened position of the mixer tap (11) or in the third pivot range (III) of the actuating lever (8), respectively, the permanent magnet (13) continuously is attracting the control pin (18) and, wherein the solenoid valve (14) in the second pivot range (II) of the actuating lever is working in a bistable manner and the control pin (18) after switching of the electromagnet (23), in dependence from the previous direction of the current in the electromagnet (23) either is maintained in the closed position of the valve by the force of the spring (25) or is maintained in the opened valve position by the magnetic force of the permanent magnet (13).

3. A single-lever mixer according to claim 2, wherein the lever arrangement (12) is performed as a reversing lever the side (28) of which being distant from the permanent magnet (13) being guided by a gate (30) pivotably connected to the control rod (10) in such a way that the electromagnet (23) in the individual pivot ranges (I–III) is adopting the necessary positions for the corresponding functions of the solenoid valve (14).

4. A single-lever mixer according to claim 2 wherein the solenoid valve (14) is performed as a pilot valve, the pilot opening (19) of which can be closed by the control pin (18).

5. A single-lever mixer according to claim 1, wherein the control piston and the shell enclosing the control piston of the mixer tap (11) are performed such that in the completely opened position of the mixer tap (11) a reducing of the fluid flow is occurring.

6. A single-lever mixer according to claim 1, wherein the electrically controllable valve (14) is completely positioned within the housing part (5) of the single-lever mixer (1).

7. A single-lever mixer according to claim 1, wherein the mixer tap (11) and the electrically controllable valve (14) are positioned within a replaceable shell (43).

8. A single-lever mixer according to claim 1, wherein the proximity sensor (37) being positioned on the bottom side of the exit part (7) by the means of a electric line extending within the housing part (5) is connected to the control circuit (39).

9. A single-lever mixer according to claim 8, wherein for the current supply of the proximity sensor (37), the control circuit (39) and the electrically controllable valve (14) there is provided a storage battery (41) and, in that the storage battery replaceably is positioned in the head piece (18) of the single-lever mixer (1).

* * * * *